US008258388B2

(12) United States Patent
Hind et al.

(10) Patent No.: US 8,258,388 B2
(45) Date of Patent: Sep. 4, 2012

(54) OCARINA KIT

(76) Inventors: John Charles Hind, Honea Path, SC (US); Eugene G. Jameson, Belton, SC (US)

( * ) Notice: Subject to any disclaimer, the term of this patent is extended or adjusted under 35 U.S.C. 154(b) by 37 days.

(21) Appl. No.: 13/048,074

(22) Filed: Mar. 15, 2011

(65) Prior Publication Data

US 2011/0226114 A1 Sep. 22, 2011

Related U.S. Application Data

(60) Provisional application No. 61/314,393, filed on Mar. 16, 2010.

(51) Int. Cl.
*G10D 7/00* (2006.01)

(52) U.S. Cl. ..... 84/330

(58) Field of Classification Search ..... 84/380 R, 84/384, 330, 385 A
See application file for complete search history.

(56) References Cited

U.S. PATENT DOCUMENTS 4,893,541 A * 1/1990 Fowler et al. ..... 84/380 C
* cited by examiner

*Primary Examiner* — Kimberly Lockett
(74) *Attorney, Agent, or Firm* — Timothy J. Monahan; Monahan & Moses, LLC

(57) ABSTRACT

A kit or puzzle for making an ocarina is provided having six planar pieces representing the top, bottom, front and two sides of a cuboid-shaped chamber, wherein the side pieces have arms that extend past the front of the chamber to support a planar mouthpiece having a windway directed at a labium positioned in the forward edge of the top piece forming the chamber. Finger holes in the top piece allow different notes to be played in the assembled ocarina.

20 Claims, 3 Drawing Sheets

OCARINA KIT

This application claims priority to U.S. Provisional Patent Application Ser. No. 61/314,393, filed Mar. 16, 2010.

This invention relates to a kit for assembling an ocarina. The kit contains pre-cut components, which can be fitted together and secured with an adhesive. The invention also relates to an ocarina made from the kit.

BACKGROUND OF THE INVENTION

The ocarina is a musical wind instrument, having a hollow body with finger holes and a projecting mouthpiece. It belongs to the family of vessel flutes, which rely on an enclosed chamber, rather than an open tube, to produce sound. Air is blown through the windway in the mouthpiece, strikes the labium and vibrates throughout the hollow body. Different notes are produced by covering and uncovering the finger holes.

The ocarina is an ancient instrument, believed to date back thousands of years. It can be made from various materials, including clay, porcelain, metal, wood and plastic. Ocarinas capable of producing a diatonic scale and/or chromatic scale are known, as are multi-chambered ocarinas, which have a range of two octaves or greater.

Nowadays, an individual interested in obtaining an ocarina can purchase one from an instrument maker. Nevertheless, making one's own instrument can be a rewarding and educational experience, especially for children interested in music and crafts. Thus, there is an unfulfilled need for a kit that allows an individual to construct a functional wind instrument, such as an ocarina.

SUMMARY OF THE INVENTION

A kit is provided, which can be assembled to make an ocarina. The hollow body portion of the ocarina is a hexahedron-shaped chamber, formed by six, planar pieces, representing the top, bottom, first side, second side, back and front of the chamber. Each of the six pieces has four edges, with at least one of the edges of each piece having a finger joint, and the finger joint in each piece is complementary with the finger joint in one of the other pieces. The pieces are assembled by engaging complementary finger joints. The finger joints facilitate assembly by maintaining alignment of the pieces. Additionally, the finger joints can be designed so that they align when the pieces are assembled correctly, but do not align when the pieces are oriented incorrectly.

The side pieces forming the chamber have arms extending beyond the front piece. The arms engage a mouthpiece, for example, with complementary finger joints provided in the arms and the mouthpiece. The mouthpiece has a windway for air, oriented parallel to the face of the mouthpiece. The windway is directed at a labium, formed by a recess in an edge of the top piece. The mouthpiece may be provided as two separate halves, with each of the halves having a complimentary groove in one face, and the windway is formed by joining the halves in overlaying orientation, with the grooves facing each other.

The top piece and/or the bottom piece, which form the chamber, have one or more finger holes therein, for producing different notes.

All of the six pieces forming the chamber and the mouthpiece, can be provided unassembled in a package, to create a kit, to be assembled by the purchaser.

In one embodiment of the invention, the pieces, including the mouthpiece are made from a sheet of wood.

DETAILED DESCRIPTION OF THE INVENTION

Without intending to limit the scope of the invention, the preferred embodiments and features are hereinafter set forth.

Figure 1:
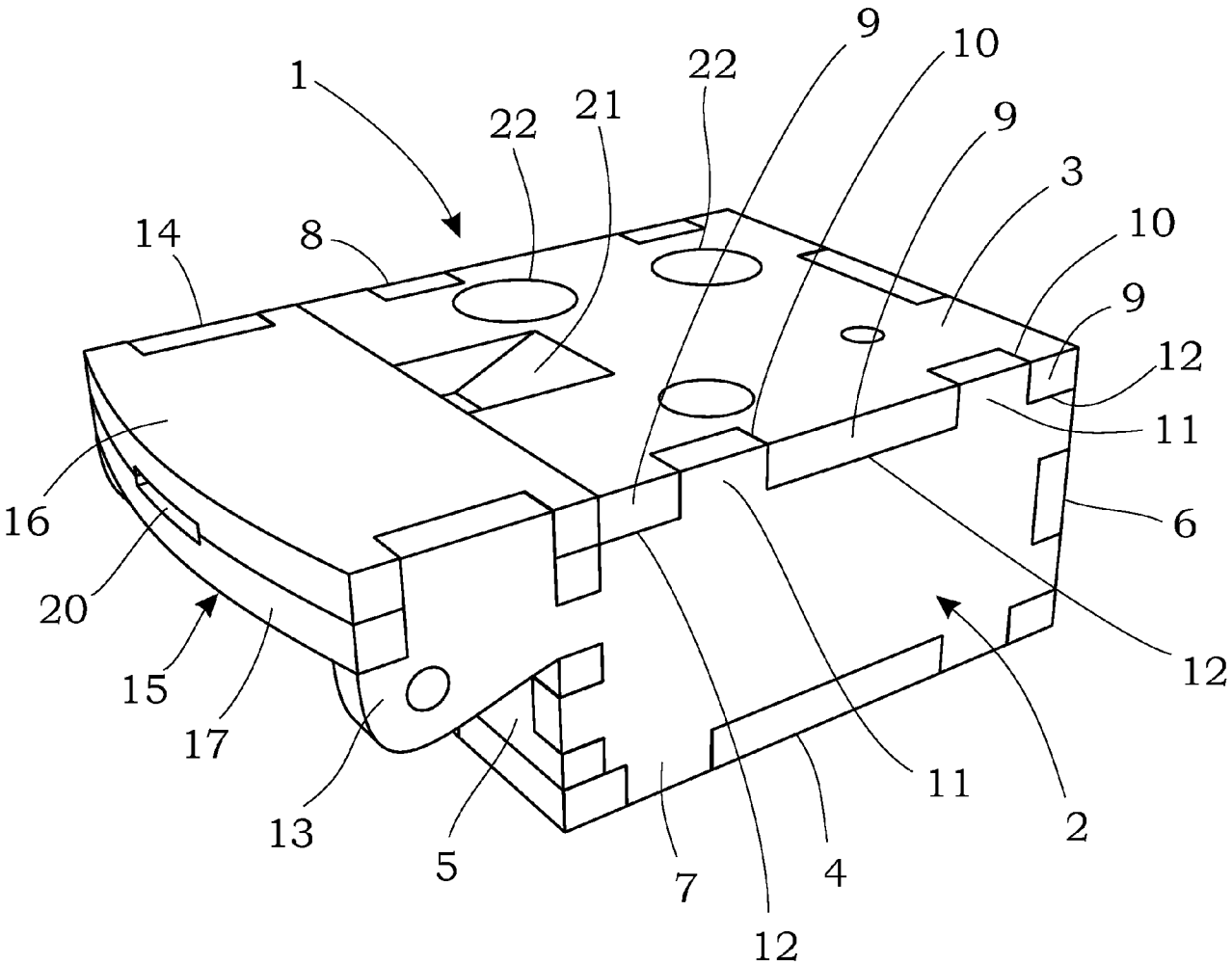
FIG. 1 is perspective view of the ocarina assembled from the kit.
Figure 2:
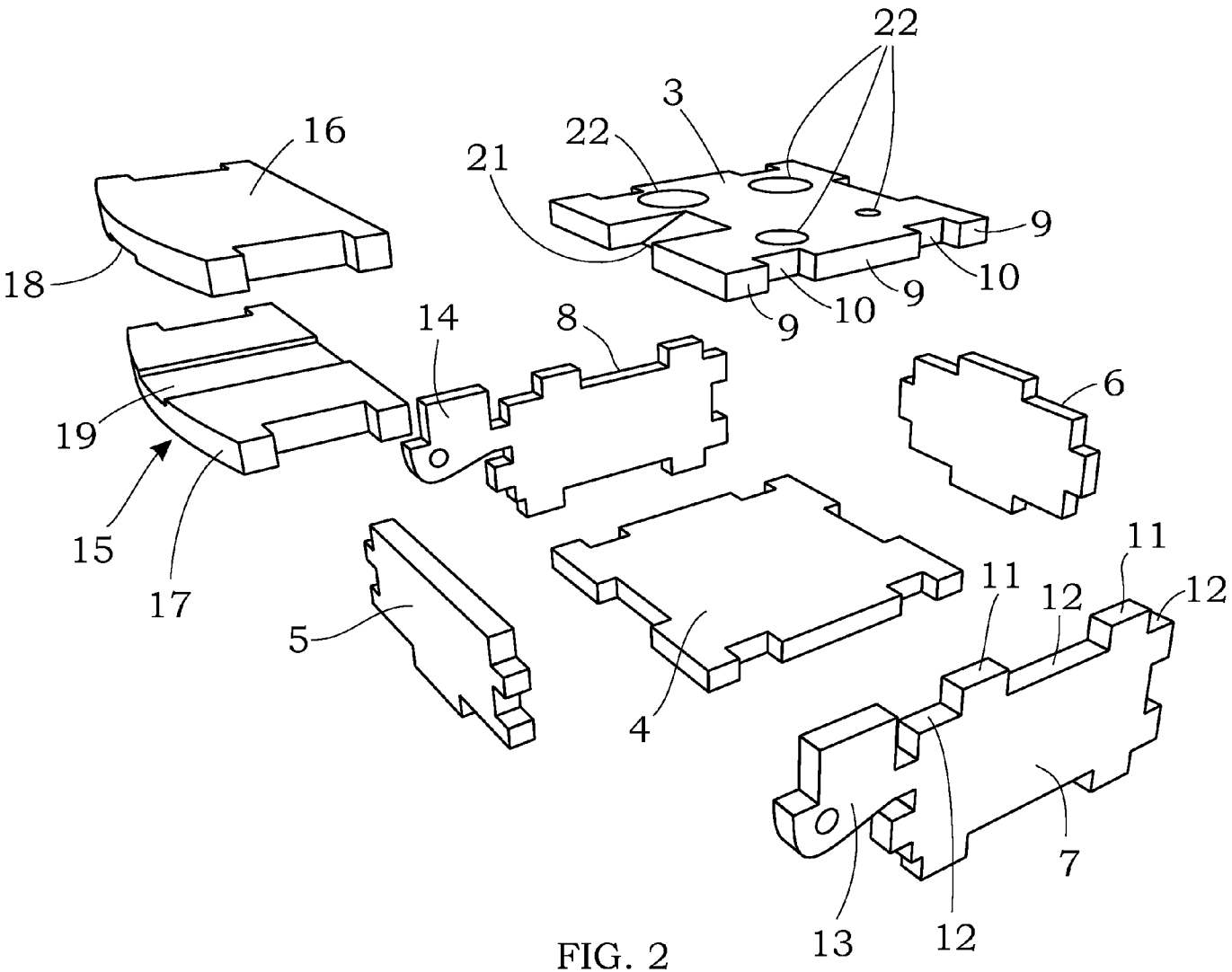
FIG. 2 is an exploded, perspective view of the ocarina shown in FIG. 1.

Referring to FIGS. 1 and 2, ocarina 1 has a hexahedron-shaped chamber 2, formed of six planar pieces, which represent the top 3, bottom 4, front 5, back 6 and side pieces 7 and 8. In the embodiment shown, the hexahedron-shaped chamber is a cuboid, that is, the pieces forming the chamber meet at right angles.

The six pieces have four sides each. The bottom 4, back 6 and both sides 7 and 8 each have finger joints on all four sides, and the top 3 and front 5 each have finger joints on three sides. The term "finger joint" is intended to include complementary projections and recesses in the edges of adjoining pieces, such as box joints, dovetail joints, and tabs and slots. By way of illustration, top 3 has projections 9 and recesses 10 along the edge adjoining side 7. Similarly, side 7 has complementary projections 11 and recesses 12 along the edge adjoining top 3.

Side edge 7 and side edge 8 have arms 13 and 14, respectively, which project beyond front 5. Arms 13 and 14 engage mouthpiece 15, at complementary finger joints along the edges formed where the upper portion of arms 13 and 14 join the side portion of mouthpiece 15. In the embodiment shown, mouthpiece 15 is made by joining together upper section 16 and lower section 17. Groove 18 in the face of upper section 16 and groove 19 in the face of lower section 17 form windway 20 in mouthpiece 15, when the upper and lower sections are joined together, as shown in FIG. 1. In an alternative embodiment, mouthpiece 15 may be a single piece with a passageway for air drilled through it to create windway 20.

Windway 20 provides a passageway for air when the ocarina is played. Windway 20 directs air at labium 21 in top 3, formed in a recess along an edge of top 3. Labium 21 tapers in thickness from back to front, so that air passing through windway 20 impinges upon the narrow edge. When the ocarina is played, the air stream oscillates between the inside and outside of chamber 2. Finger holes 22 located in the top 3 of chamber 2, allow the player to produce different notes. In various embodiments of the invention, the number, size and arrangement of the finger holes allow ocarina 1 may be selected to produce a diatonic scale and/or full chromatic scale. In the ocarina shown in FIG. 1, four finger holes have been found to be sufficient to produce a diatonic scale or full chromatic scale.

The pieces that can be assembled into the ocarina of the present invention may be made of any of a variety of materials. By way of example, the pieces may be thin boards or sheets of wood, especially plywood, cut by computer controlled laser, saw or router. Other suitable materials include thermoplastic polymers, thermosetting polymers, ceramics and metals, which have been formed into sheets and/or planar pieces by stamping, cutting, molding, casting or extrusion. By way of example, the pieces forming the ocarina may range in thickness from 1/64 inch to 3/4 inch, with a range in thickness of from 1/16 inch to 5/16 inch believed to be particularly useful for laser-cut wood pieces.

The individual pieces comprising the ocarina may be held together by an adhesive suitable to the material of construction. By way of example, water-based adhesives, such as carpenter's glue, organic solvent-based adhesives, liquid instant glue, rubber cement, model glue, reactive glue, such as epoxies, and hot melt adhesives may be employed.

Figure 3:
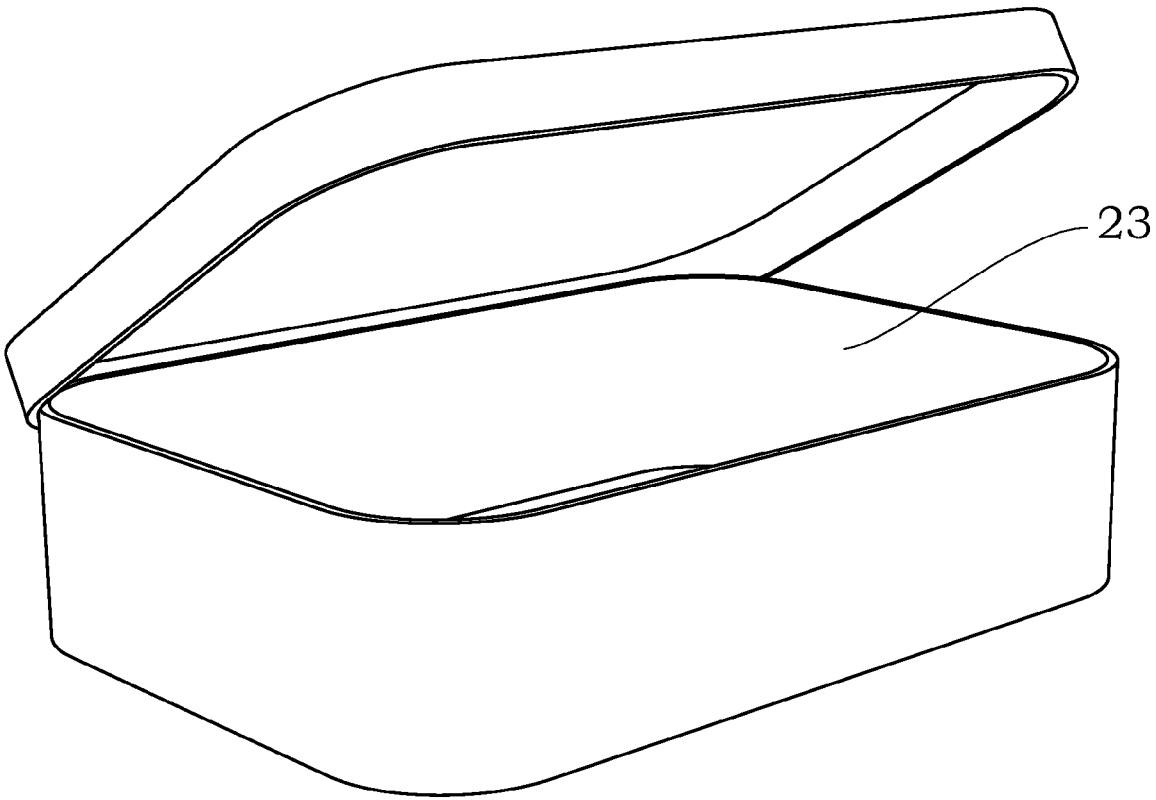
FIG. 3 is a perspective view of a tin suitable for packaging the kit.

The kit of the present invention includes assembly instructions, playing instructions and sheet music, all in paper format. Additionally, the kit may include a box, such as a metal tin with a lid, which can accommodate the pieces to be assembled, as well as the instructions and sheet music, such as tin 23 shown in FIG. 3.

The ocarina may be assembled by first gluing together, in order, the front and bottom, two sides and the back. Next, the lower section of the mouthpiece is glued to the structure, followed by the upper section of the mouthpiece. Last, the top is glued on to complete the ocarina. Prior to adding the top piece to the assembly, the edges can be "welded" together with extra glue, and the inside of the chamber can be sealed by, for example when the pieces are wood, applying shellac or water-based craft paint. After the ocarina is assembled, the exterior is sealed, for example, by applying shellac or water-based paint, or other finish appropriate for the material of construction.

The invention may be further understood by reference to the following claims.

What we claim is:

1. An ocarina kit, comprising:

(a) six planar pieces, each of the pieces having four edges, wherein at least one of the edges of each piece has a finger joint, and the finger joint in each piece is complementary with the finger joint in one of the other pieces, wherein the six pieces represent the top, bottom, first side, second side, back and front of a hexahedron-shaped chamber when the pieces are assembled by engaging complementary finger joints, wherein each of the first and second side pieces has an arm extending beyond the front piece of the chamber when the pieces are assembled, wherein the top piece has a labium formed by a recess in one of its edges, and wherein at least one of the top piece and bottom piece has a finger hole extending perpendicular through such piece;

(b) a planar mouthpiece having a windway for air parallel to a face of the mouthpiece, wherein the mouthpiece is engagable with the arms of the first and second sides, such that the windway is directed toward the labium in the top piece; and (c) wherein the six pieces and mouthpiece are provided unassembled in a package.

2. The ocarina kit of claim 1, wherein the six pieces represent the top, bottom, first side, second side, back and front of a cuboid-shaped chamber when the pieces are assembled by engaging complementary finger joints.

3. The ocarina kit of claim 1, wherein the six pieces and mouthpiece are wood.

4. The ocarina kit of claim 1, wherein the mouthpiece is provided as two separate halves, each of the halves having a complimentary groove in one face, whereby the windway is formed by joining the halves in overlaying orientation, with the grooves facing each other.

5. The ocarina kit of claim 1, wherein the mouthpiece has side edges, perpendicular to the windway, wherein each of the mouthpiece side edges has a finger joint, and each of the arms of the first and second side pieces has a finger joint that is complementary to one of the finger joints in the mouthpiece.

6. The ocarina kit of claim 1, wherein the bottom, first side, second side and back pieces each have four edges with finger joints.

7. The ocarina kit of claim 6, wherein the top and front pieces each have three edges with finger joints.

8. The ocarina kit of claim 1, wherein the top piece has four finger holes.

9. The ocarina kit of claim 8, wherein the ocarina assembled from the kit is capable producing a diatonic scale.

10. The ocarina kit of claim 1, wherein the ocarina assembled from the kit is capable producing a full chromatic scale.

11. An ocarina kit, comprising a plurality of interlocking planar pieces that can be assembled to form a cuboid-shaped chamber with a mouthpiece having a windway directed to a labium provided in one of the pieces forming the chamber, wherein a plurality of finger holes are provided in the pieces forming the cuboid-shaped chamber.

12. The ocarina kit of claim 11, wherein the mouthpiece is provided as two separate halves, pieces, each of the halves having a complimentary groove in one face, whereby the windway is formed by joining the halves in overlaying orientation, with the grooves facing each other.

13. An ocarina, comprising:

(a) a cuboid-shaped chamber formed by six interlocking planar pieces, representing a top, bottom, first side, second side, back and front, wherein the chamber has a labium formed by a recess in the top, and the chamber has a plurality of finger holes; and (b) a mouthpiece, extending from the front of the chamber, having a windway for air, wherein the windway is positioned to direct air at the labium and into the chamber.

14. The ocarina of claim 13, wherein each of the six pieces has at least one edge with a finger joint therein, and the finger joint in each piece is complementary with the finger joint in one of the other pieces.

15. The ocarina of claim 14, wherein the bottom, first side, second side and back pieces each have four edges with a finger joint therein, and the top and front pieces each have three edges with a finger joint therein.

16. The ocarina of claim 13, wherein the mouthpiece is made from two separate halves bonded together, each of the halves having a complimentary groove in one face, whereby the windway is formed by joining the halves in overlaying orientation, with the grooves facing each other.

17. The ocarina of claim 13, wherein each of the first and second side pieces has an arm extending beyond the front piece of the chamber, and the mouthpiece engages the arms of the first and second sides.

18. The ocarina of claim 17, wherein the mouthpiece has side edges, perpendicular to the windway, wherein each of the mouthpiece side edges has a finger joint, and each of the arms of the first and second side pieces has a finger joint that is complementary to one of the finger joints in the mouthpiece.

19. The ocarina of claim 13, wherein the pieces are made of plywood.

20. The ocarina of claim 13, wherein the pieces have a thickness ranging from 1/16 inch to 5/16 inch.

* * * * *